US010787877B2

(12) United States Patent
Pedersen et al.

(10) Patent No.: US 10,787,877 B2
(45) Date of Patent: Sep. 29, 2020

(54) BLOWOUT PREVENTER CONTROL SYSTEM AND METHODS FOR CONTROLLING A BLOWOUT PREVENTER

(71) Applicant: Maersk Drilling A/S, Kgs. Lyngby (DK)

(72) Inventors: John Pedersen, Frederikssund (DK); Michal Bury, Spring, TX (US); Kenneth Cameron Murphy, Houston, TX (US)

(73) Assignee: MAERSK DRILLING A/S, Kgs. Lyngby (DK)

( * ) Notice: Subject to any disclaimer, the term of this patent is extended or adjusted under 35 U.S.C. 154(b) by 0 days.

(21) Appl. No.: 15/742,671

(22) PCT Filed: Jul. 6, 2016

(86) PCT No.: PCT/DK2016/000027
§ 371 (c)(1),
(2) Date: Jan. 8, 2018

(87) PCT Pub. No.: WO2017/005262
PCT Pub. Date: Jan. 12, 2017

(65) Prior Publication Data

US 2018/0202252 A1 Jul. 19, 2018

(30) Foreign Application Priority Data

Jul. 6, 2015 (DK) ..... 2015 00385
Jul. 17, 2015 (DK) ..... 2015 00418

(51) Int. Cl.
*E21B 33/035* (2006.01)
*E21B 33/038* (2006.01)
(Continued)

(52) U.S. Cl.
CPC ..... *E21B 33/0355* (2013.01); *E21B 33/038* (2013.01); *E21B 33/063* (2013.01);
(Continued)

(58) Field of Classification Search
CPC .. E21B 33/0355; E21B 33/038; E21B 33/063; E21B 33/064; E21B 34/16; E21B 47/06
See application file for complete search history.

(56) References Cited

U.S. PATENT DOCUMENTS 6,032,742 A 3/2000 Tomlin et al.
6,422,315 B1 7/2002 Dean
(Continued)

FOREIGN PATENT DOCUMENTS

EP 2 458 142 A2 5/2012
KR 2015 0003191 U 8/2015
(Continued)

OTHER PUBLICATIONS

International Search Report (PCT/ISA/210) dated Nov. 10, 2016, by the European Patent Office as the International Searching Authority for International Application No. PCT/DK2016/000027.
(Continued)

*Primary Examiner* — Matthew R Buck
(74) *Attorney, Agent, or Firm* — Buchanan Ingersoll & Rooney PC

(57) ABSTRACT the present invention relates to a blowout preventer system comprising, a lower blowout preventer (BOP) stack comprising a number of hydraulic components, and a lower marine riser package (LMRP) comprising a first control pod and a second control pod adapted to provide, during use, redundant control of hydraulic components of the lower blowout preventer stack where the first and the second control pods are adapted to being connected, during use, to a surface control system and to be controlled, during use, by
(Continued)

the surface control system, wherein the blowout preventer system further comprises at least one additional control pod connected to at least one additional surface control system and to be controlled, during use, by the additional surface control system. In this way, an improved blowout preventer system is provided.

20 Claims, 4 Drawing Sheets

(51) Int. Cl.

| | |
|---|---|
| ***E21B 33/064*** | (2006.01) |
| ***E21B 34/16*** | (2006.01) |
| ***E21B 47/06*** | (2012.01) |
| ***E21B 33/06*** | (2006.01) |
| *E21B 41/04* | (2006.01) |

(52) U.S. Cl.
CPC ..... *E21B 33/064* (2013.01); *E21B 34/16* (2013.01); *E21B 47/06* (2013.01); *E21B 41/04* (2013.01)

(56) References Cited

U.S. PATENT DOCUMENTS

| | | | | |
|---|---|---|---|---|
| 7,261,162 | B2 * | 8/2007 | Deans | E21B 41/0007 166/250.01 |
| 8,393,399 | B2 * | 3/2013 | Judge | E21B 33/076 166/344 |
| 8,684,088 | B2 * | 4/2014 | Zediker | E21B 33/063 166/338 |
| 9,033,049 | B2 * | 5/2015 | Kotrla | E21B 33/0355 166/338 |
| 9,175,538 | B2 * | 11/2015 | Wordley | E21B 33/0355 |
| 9,702,210 | B2 * | 7/2017 | Dirksen | E21B 21/12 |
| 9,970,287 | B2 * | 5/2018 | Jaffrey | E21B 33/0355 |
| 10,202,839 | B2 * | 2/2019 | Scott | E21B 47/0001 |
| 2003/0006070 | A1 | 1/2003 | Dean | |
| 2009/0095464 | A1 | 4/2009 | McGrath et al. | |
| 2012/0111572 | A1 | 5/2012 | Cargol, Jr. | |
| 2012/0132431 | A1 | 5/2012 | Ebenezer | |
| 2015/0198001 | A1 | 7/2015 | McWhorter et al. | |
| 2016/0090810 | A1 | 3/2016 | Holmes et al. | |

FOREIGN PATENT DOCUMENTS

| | | |
|---|---|---|
| WO | WO 2007/016678 A2 | 2/2007 |
| WO | WO 2009/039349 A1 | 3/2009 |
| WO | WO 2014/074973 A1 | 5/2014 |
| WO | WO 2016/054221 A1 | 4/2016 |

OTHER PUBLICATIONS

Written Opinion (PCT/ISA/237) dated Nov. 10, 2016, by the European Patent Office as the International Searching Authority for International Application No. PCT/DK2016/000027.

Danish Search Report dated Feb. 26, 2016, issued in corresponding Danish Patent Application No. PA 2015 00418. (4 pages).

* cited by examiner

BLOWOUT PREVENTER CONTROL SYSTEM AND METHODS FOR CONTROLLING A BLOWOUT PREVENTER

FIELD OF THE INVENTION

This invention relates to a novel method and apparatus for offshore drilling operations.

BACKGROUND

Blowout preventers (BOP) are used in hydrocarbon drilling and production operations as a safety device that closes, isolates, and/or seals the wellbore. Blowout preventers are essentially large valves that are connected to the wellhead and comprise closure members capable of sealing and closing the well in order to prevent the release of high-pressure gas or liquids from the well.

One type of blowout preventer used extensively in both low and high-pressure applications is a ram-type blowout preventer. A ram-type blowout preventer uses two opposed closure members, or rams, disposed within a specially designed housing or body. The blowout preventer body has a bore that is aligned with the wellbore. The rams are equipped with sealing members that engage to prohibit flow through the bore when the rams are closed. The rams may be pipe rams, which are configured to close and seal an annulus around a pipe that is disposed within the bore, or may be blind rams or shearing blind rams, which are configured to close and seal the entire bore.

A particular drilling application may require a variety of pipe rams, shear rams, and blind rams. Therefore, in many applications multiple blowout preventers are assembled into blowout preventer stacks that comprise a plurality of ram-type blowout preventers, each equipped with a specific type of ram. The BOP stack (i.e. the stack of individual BOPs) may further include annular BOPs.

The drilling system typically further comprises a Lower Marine Riser Package (LMRP; see e.g. 206 in FIG. 1 and 410 in FIGS. 2-4) that is removably connected to the top of the lower BOP stack at the LMRP's lower end and to a marine riser at its upper end. The LMRP is an upper section of a two-section subsea BOP stack and interfaces with the lower subsea BOP stack. The LMRP may also be referred to as upper stack assembly or LMRP assembly. The lower BOP stack may also be referred to as lower BOP stack assembly.

Ram-type blowout preventers are often configured to be operated using pressurized hydraulic fluid to control the position of the closure members relative to the bore. Although most blowout preventers are coupled to a fluid pump or some other active source of pressurized hydraulic fluid, many applications require a certain volume of pressurized hydraulic fluid to be stored and immediately available to operate the blowout preventer in the case of emergency. For example, many subsea operating specifications require a blowout preventer stack to be able to cycle (i.e., move a closure member between the extended and retracted position) several times using only pressurized fluid stored on the stack assembly in one or more suitable containers or similar. In high-pressure large blowout preventer stack assemblies, several hundred gallons of pressurized fluid may have to be stored on the stack.

Presently, certain LMRPs typically comprises control two pods (see e.g. 310 and 320 in FIG. 1) where each control pod is associated with a separate hydraulic supply conduit and contains electronics and valves that are used for monitoring and control of a wide variety of functions related to drilling operations, as generally known.

A control pod is an assembly of valves and regulators (either hydraulically or electrically operated) that when activated in response to one or more control signals will direct hydraulic fluid through apertures or the like to operate the BOP functions. A control pod is sometimes also referred to as an electro/hydraulic (E/H) pod. For deep sea depths (500 meters and more) control pods are typically electrical for communications purposes (while still receiving pressurized hydraulic fluid for operating BOP functions). For smaller depths (less than about 500 meters), control pods may be hydraulic and/or electrical for communications purposes.

Requirements according to the API (the American Petroleum Institute) as well as normal "oil-field tradition" typically classify one of the hydraulic supply conduits as a "Blue" supply where the other hydraulic supply conduit is classified as a "Yellow" supply. The control pod traditionally associated with the Blue supply is typically classified as the Blue control pod or BL pod. Conversely, the other control pod is traditionally classified as the Yellow control pod or YL pod.

These two control pods provides redundant control systems and are capable of performing a common set of function. Thereby redundant control is provided by having two similar/identical pods so that if there is a failure in one "on line" pod, e.g. a failure of electronics or of a valve, the other "standby" pod can be brought to an "on line" status, e.g. by a driller, to immediately perform the required actions or functions.

Returning a pod to the surface for replacement or for rep is a con p ex and costly operation.

Returning equipment to the surface and bringing it back to the wellhead again is associated with a significant time use (even more so for deep sea operations due to the operating depths being worked at) during which any hydrocarbon drilling and production operations are suspended. The unproductive time involves a significant economic cost.

Additionally, since traditional safety requirements in connection with certain well operations dictate having redundancy in relation to well control (if e.g. one control pod reports an error, becomes non-operational, etc.) operations has to be suspended since there then no longer is any redundant control system in place, even though one control system is working perfectly well. This is also associated with unproductive time and economical costs.

SUMMARY

It is an object to alleviate at least one or more of the above mentioned drawbacks at least to an extent.

It is an object to enable continued operation with redundancy even if one of the control pods becomes unavailable.

Additionally, it is an object to provide increased safety.

An embodiment of the invention is defined in claim 1.

Accordingly, in some embodiments the present invention relates to a blowout preventer system comprising:

- a lower blowout preventer (BOP) stack comprising a number of hydraulic components,
- a lower marine riser package (LMRP) comprising a first control pod and a second control pod adapted to provide, during use, redundant control of hydraulic components of the lower blowout preventer stack where the first and the second control pods are adapted to being connected, during use, to a surface control system and to be controlled, during use, by the surface control system, wherein the blowout preventer system further comprises at least one additional control pod connected to at least one additional surface control system and to be controlled, during use, by the additional surface control system.

In this way, continued operation is enabled even if one of the other control pods becomes unavailable since redundancy is still available, even in this case. This may avoid the need e.g. for tripping the LMRP to the surface and back again to the wellhead, which increases the operational time and avoid costly unproductive downtime.

Having at least one additional control pod provides an additional backup control system for BOP functions. Some blowout preventer systems comprise e.g. an acoustic system and/or ROV operated safety measures. However, the at least one additional control pod may easily have a much quicker response time than establishing communication with an acoustic system and in particular deploying an ROV and bringing it to the BOP.

The at least one additional control pod and the least one additional surface control together provides a standalone backup system separated from the traditional main BOP control system at least as far as reasonably practicable.

Additionally, the at least one additional control pod can provide a backup to an autoshear/deadman circuit, which traditional first and second control pods generally cannot.

The surface control system controlling the first and the second control pods are generally well known and is e.g. explained further in connection with FIG. 1.

The additional surface control system is a system independent from the surface control system controlling the first and second control pods of the LMRP (even though signals between the additional surface control system and the at least one additional control pod at least in some embodiments may be routed via the surface control systems controlling the first and second control pods). The additional surface control system is preferably implemented as a physically separate hardware system, which provides further redundancy to the surface control system controlling the first and the second control pods. In some embodiments, the connection(s) between the at least one additional control pod and the at least one additional surface control system runs in the MUX cables (both yellow and blue) together with the connections for the first and second control pod.

The LMRP (together with the first and second control pods) is releasably connected to the lower BOP stack (e.g. as shown as 204 in FIGS. 1-4).

In some embodiments, the at least one additional control pod is located on the lower blowout preventer stack. This location is opposed to being located on the LMRP. In this way, the at least one additional control pod is a part of or constitutes a component of the lower blowout preventer stack. As mentioned, the LMRP is releasably connected to the lower BOP stack typically via one or more stack connectors then forming a boundary between the LMRP and the lower BOP stack. In such cases, the additional control pod will be located below (further towards the seabed on the BOP is installed and is attached to the LMRP) the stack connectors. The stack connectors may e.g. include one or more hydraulic connection elements, e.g. one or more hydraulic stabs or the like, and in some embodiments, one or more electrical (or alternatively optical) connectors, e.g. an electrical (or alternatively optical) wet-mate or the like. It is e.g. advantageous to have the at least one additional control pod being located on the lower BOP stack since lower BOP functions then may be carried out even after disconnect of the LMRP, which generally is not possible at least for certain previous BOP systems since the first and the second control pod follows the LMRP.

In some embodiments, the blowout preventer system further comprises an additional subsea control unit wherein the additional subsea control unit is connected to one or more of the at least one additional control pods, and adapted to control, during use, the one or more of the at least one additional control pod and wherein the additional subsea control unit is further connected to the additional surface control system.

In some embodiments, the at least one additional control pod is (each) adapted to carry out only about ten, e.g. ten, to about twelve, e.g. twelve, (where the actual number may vary and be dependent on actual use or implementation) predetermined functions, The first and second control pods are often adapted to carry out about 160 different functions. Supporting far fewer functions reduces the overall complexity of the additional control pod, and possibly its manufacturing costs, compared to the conventional control pods.

Additionally, having fewer functions may very well reduce the potential failure rate of an additional control pod compared to each of the first and second control pods. This is achieved while still providing additional redundancy and/or back up.

In some embodiments, the at least one additional control pod is (each) adapted to carry out less than 150 functions e.g. less than 100, such as less than 75, such as less than 50, such as less than 25, such as less than 20, or such as less than 15.

In some embodiments, preferably only safety critical functions and/or SIF (safety instrumented function) functions are supported by the at least one additional control pod. This keeps the number of supported functions relatively low (with the advantages as mentioned above) and for SIF functions it facilitates a simpler procedure for obtaining and/or maintaining a SIL (safety integrity level) rating.

Safety critical functions within the present context is a standardized term according to the international standard IEC 61508 titled 'Functional Safety of Electrical/Electronic/Programmable Electronic Safety-related Systems' published by International Electrotechnical Commission.

A SIF is also a standard well known term and is a function carried out by a SIS (Safety Instrumented System). A SIS typically consists of an engineered set of hardware and software controls which are especially used on critical process systems. A critical process system can be identified as one which, once running and an operational problem occurs, may need to be put into a "safe state" to avoid adverse consequences. The international standard IEC 61511 is a technical standard that sets out practices in the engineering of SIS systems that ensure the safety of an industrial process through the use of instrumentation. A SIL (Safety Integrity Level) rating is defined as a relative level of risk-reduction provided by a safety function, or to specify a target level of risk reduction. A SIL may be regarded as a measurement of performance required for a safety instrumented function (SIF). The requirements for a given SIL are not consistent among all of the functional safety standards. In the European functional safety standards based on the IEC 61508 standard, four SILs are defined, with SIL 4 being the most dependable and SIL 1 the least. A SIL is determined based on a number of quantitative factors in combination with qualitative factors such as development process and safety life cycle management. Furthermore, OLF-070 or NOG-070 refers to standard Guidelines for the Application of IEC 61508 and IEC 61511 in the petroleum activities on the continental shelf in relation of SIFs.

These standards and guidelines and their respective content are well known by a person skilled in the art.

In some embodiments, the one or more additional control pods are SIL rated, i.e. they have been designed to be a SIS according to the appropriate standards and/or guidelines mentioned above.

In some embodiments, the at least one additional control pod is adapted to carry out a number of functions being selected from a predetermined group of safety critical functions, wherein the predetermined group of safety critical functions comprises one or more selected from the group of:

closing of one or more, e.g. all, shear ram, closing of one or more, e.g. all, pipe ram, engaging ram locks, and/or unlatching a lower marine riser package connector, thereby enabling separating the lower marine riser package from the lower blowout preventer stack.

In some embodiments, the additional surface control system is adapted to receive one or more input signals, during use, from one or more selected from the group consisting of:

the surface control system, a surface flow meter, measuring one or more current flows of hydraulic fluid to the lower blowout preventer stack, a lower marine riser package or a pressure transmitter located on the lower marine riser package, and/or a power and/or communication hub or similar of the lower marine riser package.

In some embodiments, the additional subsea control unit is adapted to receive one or more input signals, during use, from one or more selected from the group consisting of:

a power and/or communication hub or similar of the lower marine riser package, a position and pressure sensor and/or a pressure transmitter of the lower blowout preventer stack, a pressure transmitter of an autoshear hydraulic circuit, a pressure transmitter of a deadman hydraulic circuit, and/or one or more pressure transmitters of a closing shear ram circuit and/or a blind shear ram circuit.

In some embodiments, the additional surface control system is adapted to receive, during use, one or more input signals representing one or more input signals to the first and/or second control pods, one or more measured current flows of hydraulic fluid to the lower blowout preventer stack, a lower marine riser package disconnect feedback signal, e.g. as obtained by a pressure transmitter or similar at the lower marine riser package, and/or one or more signals obtained from a power and/or communication hub or similar of the lower marine riser package.

In some embodiments, the additional subsea control unit is adapted to receive, during use, one or more input signals representing one or more signals, e.g. obtained from a power and/or communication hub or similar of the lower marine riser package, one or more values of one or more blowout preventer system functions, e.g. as obtained by a position and pressure sensor or a pressure transmitter of the lower blowout preventer stack, a feedback close signal for an autoshear hydraulic circuit, e.g. as obtained by a pressure transmitter of the autoshear hydraulic circuit, a feedback close signal for a deadman hydraulic circuit, e.g. as obtained by a pressure transmitter of the deadman hydraulic circuit, and/or one or more feedback close signals for at least one closing shear ram circuit and/or at least one blind shear ram, e.g. as obtained by one or more pressure transmitters of a closing shear ram circuit and/or a blind shear ram.

In some embodiments, the additional subsea control unit is adapted to initiate, during use, one or more safety instrumented functions in response to a control signal received from the additional surface control system and/or in response to its own control logic.

In some embodiments, the blowout preventer system further comprises one or more subsea accumulators connected to the additional control pod and/or, if present, one or more acoustic control pods, and/or an autoshear and/or deadman hydraulic circuit.

In some embodiments, the blowout preventer system and the lower marine riser package are adapted to be connected, during use, by one or more hydraulic connection elements, e.g. one or more hydraulic stabs or the like, and/or one or more electrical or optical connectors, e.g. an electrical wet-mate or the like.

In some embodiments, the additional subsea control unit and/or the additional surface control system are adapted, during use, to monitor one or more functions of the lower blowout preventer stack.

In some embodiments, the at least one additional control pod is controllable to be enabled, disabled, or electrically live only.

In some embodiments, the at least one additional control pod is controllable to enter a lower blowout preventer stack test mode, and/or enter a test mode for the at least one additional control pod.

In some embodiments, the additional subsea control unit, and/or the additional surface control system is/are adapted to activate, during use, at least one safety instrumented function (SF) in response to certain predetermined conditions.

In some embodiments, the additional subsea control unit and/or the additional surface control system is/are adapted to activate, during use, at least one safety instrumented function (SIF) in response to one or more of the following:

a lower marine riser package disconnect feedback signal, where the disconnect feedback signal indicates whether a disconnect signal has been given and/or executed, e.g. as obtained by a pressure transmitter or similar at the lower marine riser package, and/or a combination of one or more values of one or more blowout preventer system functions, e.g. as obtained by a position and pressure sensor and/or a pressure transmitter of the lower blowout preventer stack, a feedback close signal for an autoshear hydraulic circuit, e.g. as obtained by a pressure transmitter of the autoshear hydraulic circuit, a feedback close signal for a deadman hydraulic circuit, e.g. as obtained by a pressure transmitter of the deadman hydraulic circuit, and/or one or more feedback close signals for at least one closing shear ram circuit and/or at least one blind shear ram, e.g. as obtained by one or more pressure transmitters of a closing shear ram circuit and/or a blind shear ram.

In some embodiments, the at least one additional control pod is located on the lower blowout preventer stack below one or more stack connectors for connecting the lower marine riser package and the lower blowout preventer stack.

In some embodiments the additional surface control system is arranged to indicate a successfully performed (or the opposite) function as carried out by the first and/or the second control pod. In this way redundancy, on the feedback received by the first and/or second control pods may be provided. Accordingly, according to some embodiments, the invention in general relates to an additional control pod, optionally with a control system (e.g. the surface control system), arranged to receive information of one or more input signals provided to the first and/or second control pods, and monitor whether a corresponding action is executed and completed (or not) by the first and/or second control pod and/or the BOP/LMRP.

If this is not the case (such as within a predetermined time) then the additional pod(s) takes/take action—as controlled by the additional surface control system and/or an additional subsea control unit—to execute the function and/or another safety critical function. Input/command and feedback signals relating to the first and/or second control pods, the status of the BOP rams/annular, etc. may thus be received by the additional surface control system and/or the additional subsea control unit.

The additional subsea control unit is designated 'additional' because it relates to the one or more additional control pods.

The additional subsea control unit or SIS subsea control unit is a subsea unit, located on the lower BOP stack, being connected to the additional surface control system. The additional subsea control unit may receive input and feedback from various sensors, etc. and may also comprises its own logic circuit, PLC(s), etc. to initiate one or more safety instrumented functions (SIFs) and/or safety critical functions.

According to some embodiments of the present invention generally relates to a blowout preventer system wherein the units, systems, and/or functionality related to the additional subsea control unit and/or the additional surface control system, including the additional subsea control unit and/or the additional surface control system, is/are certified according to a predetermined safety requirement, rating, standard or the like, e.g. according to a SIL (safety integrity level) rating or standard.

In some embodiments all, of the following, are SIL rated (e.g. to a SIL rating of 2) as one connected system:

the additional subsea control unit, the additional surface control system, and the at least one additional control pod.

In some embodiments, the blowout preventer system further comprises at least one acoustic control pod and one or more acoustic subsea control units adapted, during use, to control the at least one acoustic control pod.

In some embodiments, at least one additional control pod comprises or is integrated with an acoustic control pod.

In some embodiments, the at least one additional control pod comprises a number of control valves or other control mechanisms where each control valve or other control mechanism is adapted, during use, to receive a control signal from a/the additional subsea control unit and, if present, the one or more acoustic subsea control units.

In some embodiments, the blowout preventer system comprises a first cable connecting at least the first control pod with a first surface control system, adapted to control the first control pod, and a second cable connecting at least the second control pod with a second surface control system, adapted to control the second control pod, wherein the first and the second cable are connected to the at least one additional control pod and wherein the at least one additional surface control system is connected to the first and/or second cable and/or to the first and/or second surface control system.

In some embodiments, the surface control system—controlling the first and the second control pods—comprises or is the first surface control system and the second surface control system.

In some further embodiments, the first cable is connected to a first subsea junction box (or similar) being connected to the first control pod and the at least one additional control pod (instead of being connected directly to the respective control pods), and the second cable is connected to a second subsea junction box (or similar) being connected to the second control pod and the at least one additional control pod (instead of being connected directly to the respective control pods), wherein first and the second subsea junction box is connected and further adapted to cross connect signals of one or more conductors of the first and/or the second cable, respectively, and to cross connect signals of one or more conductors between the first subsea junction box and the additional control pod, and/or signals of one or more conductors between the second subsea junction box and the additional control pod.

In some embodiments, the first surface control system is further adapted to control the second control pod, the second surface control system is further adapted to control the first control pod, and the at least one additional surface control system is adapted to control the at least one additional control pod selectively via the first or the second cable.

In this way one or more, such as all, of the first, second, and the one or more additional control pods (and one or more acoustic pods if any; e.g. integrated together with the additional control pod(s)) may communicate with the surface even if one of the traditionally used cables (often referred to as MUX cables) are or becomes dysfunctional.

In some embodiments, the subsea junction boxes (or similar) are located on the LMRP.

in some embodiments the present invention generally relates to a lower blowout preventer (BOP) stack is provided comprising at least one additional control pod (as described and embodied elsewhere) adapted to be connected, during use, to an additional surface control system (as described and embodied elsewhere).

Further embodiments are defined in the accompanying dependent claims and/or described throughout the description.

DETAILED DESCRIPTION

Various aspects and embodiments of a blowout preventer control system, a blowout preventer system, and methods for controlling a blowout preventer as disclosed herein will now be described with reference to the figures.

When relative expressions such as "upper" and "lower", "right" and "left", "horizontal" and "vertical", "clockwise" and "counter clockwise" or similar are used in the following terms, these refer to the appended figures and not necessarily to an actual situation of use (for lower BOP, upper BOP, upper and lower do also refer to an actual situation of use). The shown figures are schematic representations for which reason the configuration of the different structures as well as their relative dimensions are intended to serve illustrative purposes only.

Some of the different components are only disclosed in relation to a single embodiment of the invention, but is meant to be included in the other embodiments without further explanation.

Figure 1:
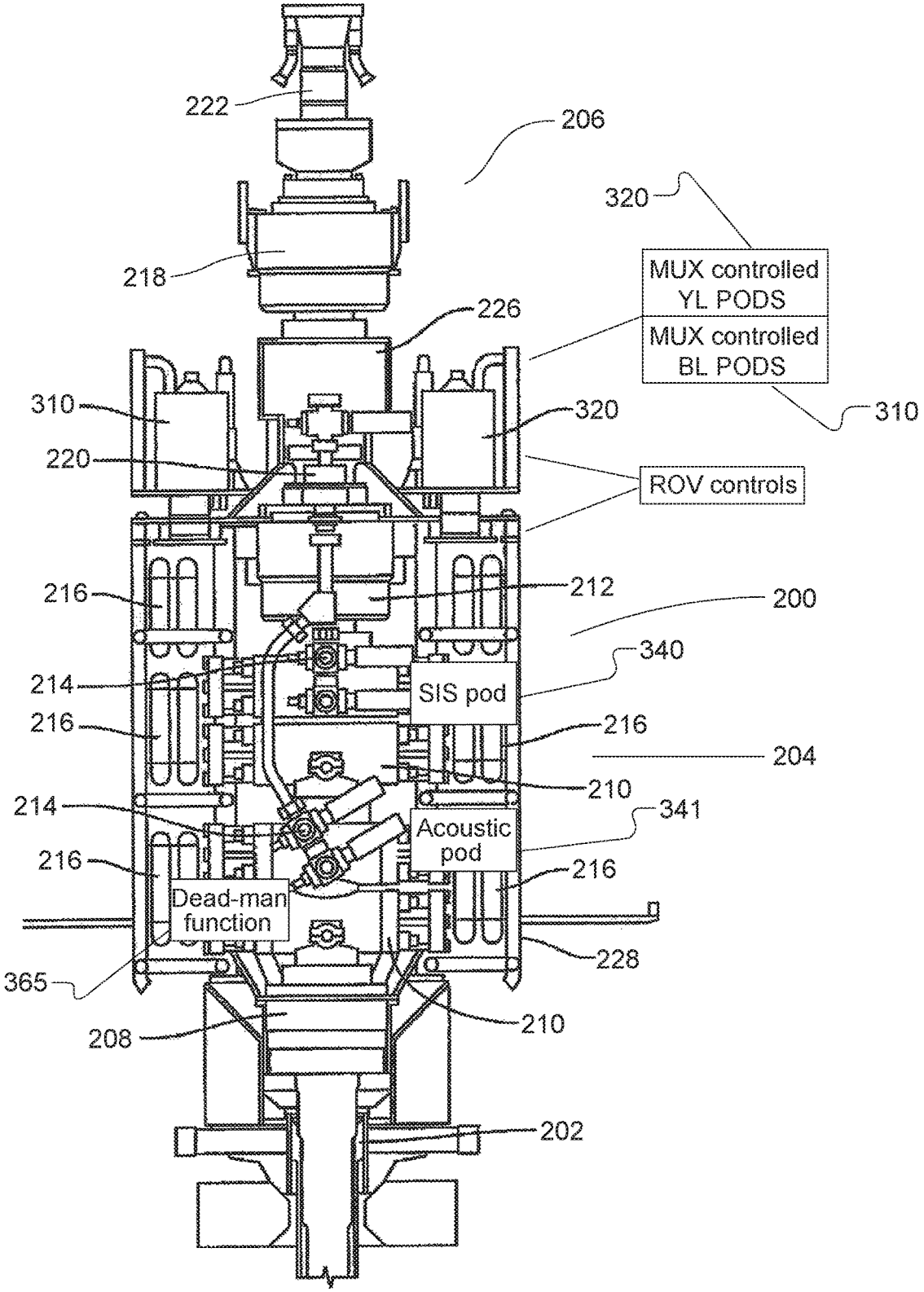
FIG. 1 schematically illustrates one embodiment of the invention implemented in a typical blowout preventer (BOP) system, FIG. 2 schematically illustrates a BOP control system according to one embodiment of the invention.

FIG. 1 schematically illustrates one embodiment of the invention implemented in a typical blowout preventer (BOP) system.

FIG. 1 illustrates a typical blowout preventer system (lower BOP stack and LMRP) 200 coupled to a wellhead 202 where an optional acoustic pod and one embodiment of one implementation of an additional control pod (denoted SIS pod) according to the present invention are also shown as will be explained further in the following.

Blowout preventer system 200 comprises a lower BOP stack assembly 204 and an upper stack assembly (also denoted LMRP) 206. Lower BOP stack assembly 204 comprises a wellhead connector 208, ram blowout preventers 210, annular blowout preventer 212, choke and kill valves 214, and hydraulic accumulators 216. Sometimes the annular blowout preventer 212 is located on the LMRP.

The LMRP 206 comprises annular blowout preventer 218, choke and kill connectors 220, riser adapter/flex joint 222, MUX controlled pods 310, 320, and LMRP connector 226. The LMRP connector 226 provides a releasable connection between the LMRP 206 and the lower BOP stack assembly 204.

Hydraulic accumulators 216 are mounted to frame 228 that surrounds lower BOP stack assembly 204. There may also be hydraulic accumulators attached to the LMRP frame.

One embodiment of possible controls for closing the BOP stack are illustrated identifying the MUX controlled YL and BL pods 310, 320, various ROV controls that may be utilized to allow an ROV to operate one or more of the BOPs (rams and/or annulars), choke/kill valves, connectors in the stack, a deadman function 365, and an acoustic pod 341. The acoustic pod 341 may e.g. be triggered remotely to initiate emergency functions like closing, isolating, and/or sealing the wellbore in case of an emergency or precautionary situation e.g. if the connections between the BL and YL pods and their surface control systems are disrupted.

The blue and yellow pods BL, YL 310, 320 are located on a LMRP connected to a riser through which drilling operations are conducted. The blue/BL control pod 310 is shown to the left in FIG. 1 while the yellow/YL control pod 320 is shown to the right. These control pods contain electronics and valves that are used in the monitoring and control of a wide variety of functions related to drilling operations. The BL and YL pods that typically are used, provides redundant systems by having two similar/identical pods so that if there is a failure in one "on line" pod, e.g. a failure of electronics or of a valve, the other "standby" pod can be brought to an "on line" status, e.g. by a driller, to immediately perform the required actions or functions. The blue and yellow pods are throughout the present specification and in the accompanying claims also denoted first and second control pod. A control pod may sometimes also be referred to as an electro/hydraulic (E/H) pod.

As mentioned, the retrieval of a control pod for replacement or for repair is a complex and expensive operation but is typically required even if the other pod is still functional. During use, the riser extends from the drill floor, e.g. from a boat or rig at the water's surface, down to the stack, "Tripping" out the riser is a long expensive process and LMRP retrieval typically requires such a "trip."

Many prior art deep water multiplexed BOP Control Systems include two identical systems either of which may control stack functions. One such system (but with additional novel features) is illustrated schematically in FIG. 1. This configuration (sans novel features) is commonly referred to as being "Dually Redundant". Both systems may be active electronically and may have single or dually redundant sets of electronic controls. One of the systems including one of the pods is active hydraulically. The system that is active hydraulically is manually selected by a driller to be the active system or "Active Pod". Each system, or pod, is equipped with a hydraulic conduit supply. This supply is run from a Hydraulic Pressure Unit (HPU) above the water surface to the pod that is mounted on the LMRP. A "Crossover Valve" may be actuated. This actuation diverts hydraulic fluid from the pod it is designed to supply to the redundant pod normally supplied by the other conduit. This "Crossover" function allows either pod to be supplied by either conduit. As mentioned, also mounted on the LMRP and/or the lower BOP stack are hydraulic accumulators 216.

These accumulators supply hydraulic fluid for the stack functions at a consistent pressure so that a function is actuated according to a manufacturer's specifications.

A typical prior art BOP control system regulates a well during drilling operations and continuously monitors the status of such operations. The BOP system includes a structure that incorporates hydraulically actuated well control safety devices and their peripheral components, i.e. a blowout preventer system. Such system may be referred to as the BOP stack or simply as the stack. The upper portion of the (two-section) stack is referred to, as mentioned, as the LMRP while the lower portion is referred to as lower BOP stack. The LMRP typically includes a platform and is the interface between the Riser system and the stack. It is a separate structure and is supplied with, or as a part of, the stack.

The LMRP is typically connected to the lower BOP stack via a hydraulically actuated stack connector. It is connected to the Riser by a "RISER" connector. Between these two connections there may be inserted annular preventer BOP's, "Pipe" BOP's (Pipe Rams), and/or other instrumentation or controlled protective and supplementary equipment.

This LMRP also physically supports hydraulic accumulators and the (blue and yellow) control pods. These control pods perform the well control regulation tasks as supervised by the driller from the drill floor of a rig. The driller may for instance regulate a parameter, i.e. a hydraulic pressure subsea on the LMRP or lower BOP stack, or control a function, i.e. close a pipe ram BOP, and/or monitor the real time actuation of the function controlled or the parameter regulated.

Many of the BOP Control System's end functions are on the lower portion of the BOP stack, i.e. below the LMRP stack connector. A command from the driller is transmitted via fiber optical and/or electrical data-cable in the MUX lines/cables (also often designated a blue and a yellow MUX line/cable, respectively). The electronic I/O (Input/Output)

equipment located in the control pod retrieves data and instructions from, and writes status to, a data connection. These instructions (commands) are typically performed with electronic I/O equipment that interfaces with electro/hydraulic functions, i.e. electrical solenoid valves. These solenoid valves either hydraulically actuate LMRP functions directly, or pilot larger valves, i.e. sub plate mounted (SPM) valves. These SPM valves supply hydraulic fluid at greater volumes or flow rates than could be accomplished with the solenoid valves themselves.

As stated above for redundancy, "Oil Field" tradition dictates that one hydraulic source be associated with one control pod, e.g. designated as the blue pod while another hydraulic source is associated with another control pod, e.g. be labelled as the yellow pod".

Each one of these pods are identical, and contain identical components, i.e. the electronic I/O, the solenoid valves, the SPM valves, and the hydraulic stab plate (LMRP side). Only one pod is hydraulically active at a time. The other pod is considered a hot back up and may be electrically active and functioning. The electronic I/O and the solenoid valves portion of the control pod may also be referred to as the Subsea Remote Terminal Unit (SSRTU).

The driller is often supplied with two panels corresponding to a control of the blue and yellow pods. A copy of these panels are typically provided at the bridge or the tool pusher's office. The combination of panels, electronics, and hydraulics located on the drilling rig is referred to as the surface MUX systems or surface control system (for the blue and yellow/first and second control pods) and typically consists of two parallel systems—one for the first/blue and one for the second/yellow. The surface MUX control system is connected to the respective pods via the MUX cables (one cables for each pod). It is a driller function to select one of the hydraulic subsea sources as active, i.e. either the blue hydraulic line or the yellow hydraulic line. Identical control activity can often also be performed in like manner from the blue or yellow toolpusher's Panel. Two computer screens with an MMI ("man-machine") interface may be provided, one in the driller's house and the other in the toolpusher's office. It is possible with some prior art systems to use the MMI's instead of the panels for primary control of the SSRTU's.

In one such prior art system in which the driller has two panels and the toolpusher has two panels (total of four panels), command data may be sent from any panel or from dual MMI interfaces to a surface mounted Programmable Logic Controller (PLC), usually in a dually redundant mode.

The surface PLC may also be referred to as a central control unit or central computer unit (CCU). The CCU processes commands through audible or optical moderns and transmits them to the SSRTU's. These SSRTU's are either PLC devices or microprocessor printed circuit boards and each SSRTU may be referred to as a controller. Each controller has associated electrical I/O units. These controllers are respectively enclosed in pod containers of the first and second control pods (also referred to as electronic pods). The SSRTU's mounted on the LMRP, one of which is the on-line unit, executes the command received from the modems. "Inferred" position sensors, pressure "feed backs", etc. transmit a signal indicating a command has been executed back to the CCU and the originating panel or MMI via modem transmissions. Activation of a pilot light or a flow meter read-back confirms the execution of the commanded function at all panels and at the MMI's. CCU functions are performed sequentially via serial data links to the remote I/O either in the panels or in the SSRTU's. If a function is not accomplished, the driller is alerted to this and can change the system configuration to put an alternate pod on-line. If, e.g. the driller is working on the blue pod fed from the blue hydraulic conduit, he first changes to the yellow hydraulic conduit and again tries to accomplish the previously-commanded function. If this does not work, the driller transfers control to the yellow pod operating of the yellow hydraulic conduit. If the commanded function still is not accomplished, the driller reconfigures the system with the yellow pod using the blue hydraulic conduit. If the command is not accomplished, typically the entire LMRP is tripped out to discover and correct the problem. This often involves bringing the LMRP to the surface, test, fix, and/or potentially replace equipment, and then bringing the LMRP back to the wellhead again for resumed operation.

In addition to the components explained above, the BOP system 200 shown in FIG. 1 further comprises a SIS (Safety Instrumented System) control pod 340 (equally referred to as additional control pod) according to an embodiment of the present invention, which is shown and explained further in the following.

Figure 2:
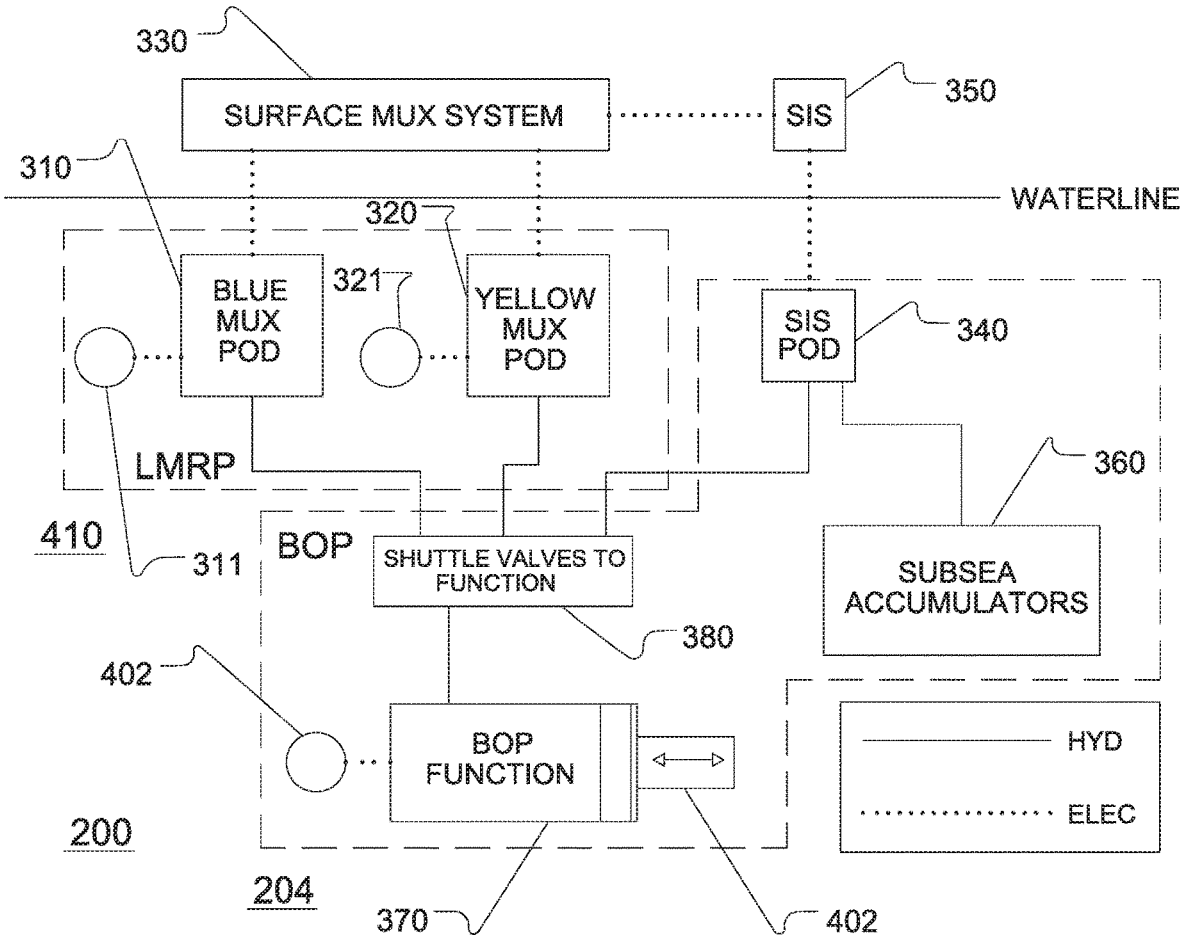

FIG. 2 schematically illustrates a BOP control system according to one embodiment of the invention.

Shown in FIG. 2 is a blowout preventer (BOP) system 200 comprising a lower blowout preventer stack 204 comprising a number of hydraulic components adapted to carry out, during use, a number of BOP related functions as described earlier and throughout the description.

The BOP system 200 further comprises a lower marine riser package (LMRP) 410 comprising a first (also designated blue) control pod 310 and a second (also designated yellow) control pod 320 adapted to provide, during use, redundant control of hydraulic components of the lower blowout preventer stack 204. The first and/or second control pods 310, 320 may e.g. be more or less conventional control pods as generally known in the art.

The LMRP 410 further comprises two flow meters 311, 321 or the like where one flow meter is connected to one of the first and second control pod and the other is connected to the other of the first and second control pod. These flow meters and/or the like may e.g. provide feedback signals, confirmations, etc. back to the surface of successful execution (or not) of a commanded function. In some embodiments, the flow meters are in line with the hydraulic system and in some embodiments one or more (such as all) these flow meters are not inline e.g. sensing the flow from the outside of the flow-line.

The first and second control pods 310, 320 are adapted to being connected, during use, to a surface control system 330 (designated surface MUX system) that controls them during operation as generally known and as described earlier. Please also refer to FIGS. 3 and 4 and related description for further details of various embodiments of how the different systems and components may be connected.

It is noted that during e.g. deep sea operations the distance between the LMRP to the surface may e.g. be as much as about 3 kilometres or even more.

The LMRP 410 is connected to the lower BOP stack 204. As mentioned earlier, The LMRP 410 may releasably be connected to the lower BOP stack 204 typically via one or more stack connectors then forming a boundary between the LMRP 410 and the lower BOP stack 204. The stack connectors may e.g. include one or more hydraulic connection elements, e.g. one or more hydraulic stabs or the like (see e.g. 381 in FIG. 3), and in some embodiments, one or more electrical (or alternatively optical) connectors, e.g. an electrical (or alternatively optical) wet-mate or the like (see e.g. 382 in FIG. 3).

The lower BOP stack 204 is adapted to carry out, during use, a number of functions carried out by BOP functional components 370 as described earlier.

One or more sensors 402 may monitor various parameter values e.g. like position and/or pressure of various components carrying out or assisting in carrying out one or more BOP functions 370. At least one of such sensors may e.g. by of the type often referred to as a Ramtel plus sensor, similar, or other.

More specifically in this particular and similar embodiments, the first and second control pods 310, 320 are connected to valves or the like 380 in the lower BOP stack 204 that is further connected to the BOP functional components 370.

As mentioned, the lower BOP stack 204 may be controlled, during regular operation, from the surface control system 330 by pumping a pressurized (control) hydraulic fluid or the like from the surface to either the first 310 or the second control pod 320 (as the other is provided only for redundancy purposes), e.g. using a crossover valve or similar, that through the valves 380 controls and/or activates the BOP functions 370.

In some embodiments the present invention generally relates to a blowout preventer system 200 further comprises an additional control pod 340 (designated SIS pod) and at least one additional surface control system 350 (designated SIS).

The additional control pod(s) is/are also equally referred to as SIS pod(s) throughout the description where SIS is short for Safety Instrumented System. The SIS pod(s) 340 may e.g. be responsible for carrying out one or more safety instrumented functions (SIFs).

The at least one additional control pod 340 is connected, electrically and/or optically, to the at least one additional surface control system 350 where the at least one additional surface control system 350 controls the at least one additional control pod 340. The additional surface control system 350 may comprise at least one control panel for the operator, e.g. one in the driller's house and another in the toolpusher's office, the bridge, etc.

As shown, the lower BOP stack 204 also comprises one or more (subsea) hydraulic accumulators or the like 360 comprising hydraulic 'working' fluid for activating various BOP or stack functions, including safety related functions, should the supply of hydraulic (working) fluid from the surface become unavailable. The one or more (subsea) hydraulic accumulators or the like 360 provide hydraulics to the at least one additional control pod 340 (and e.g. to at least one acoustic control pod and/or to an autoshear and deadman hydraulic circuit, if present; see below).

The blowout preventer system 200 may comprise precisely one additional control pod 340. Alternatively, the blowout preventer system 200 may comprise two additional control pods 340. As yet another alternative, the blowout preventer system 200 may comprise three or more additional control pods 340.

Figure 3:
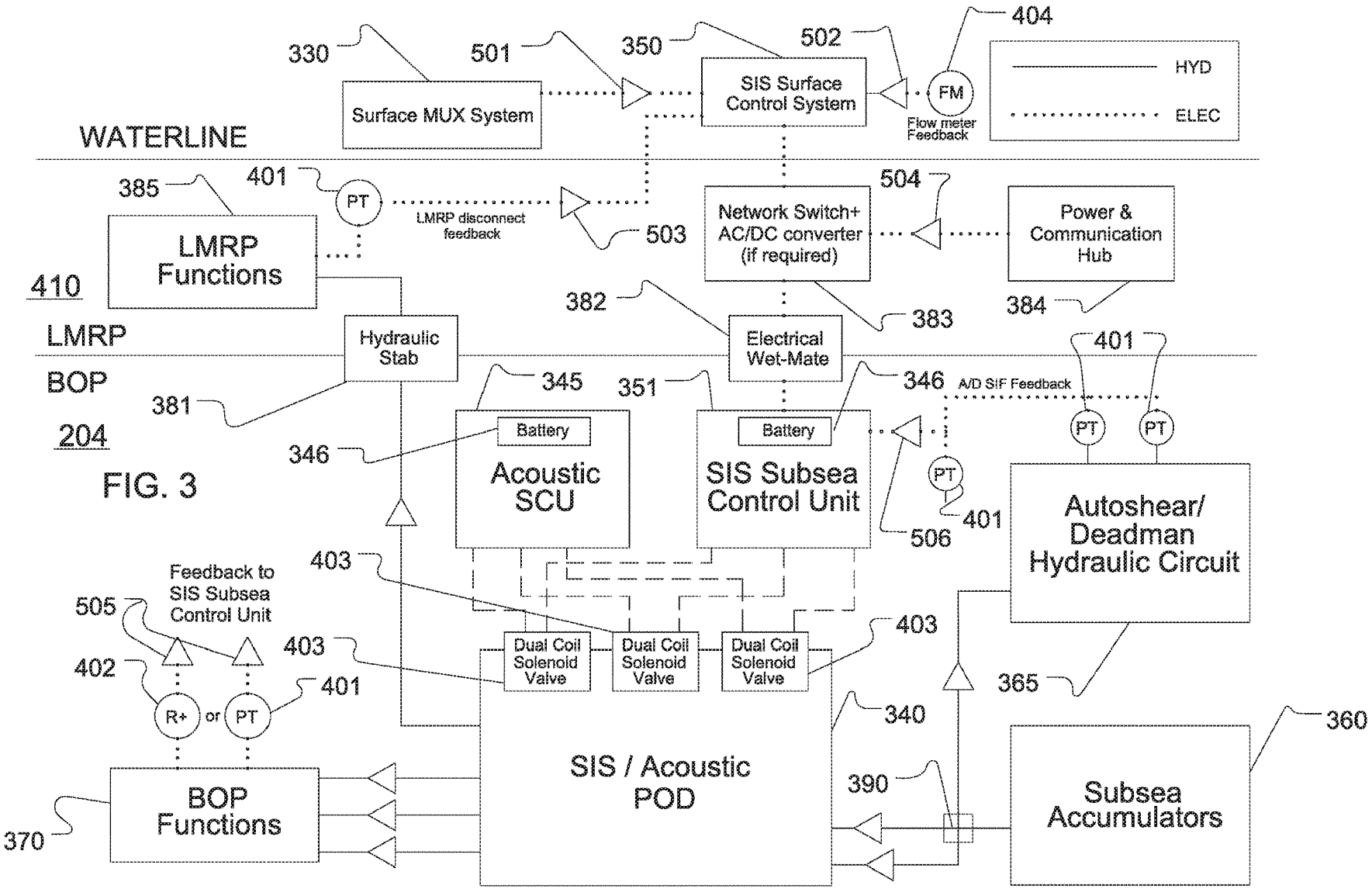
FIG. 3 schematically illustrates a BOP control system according to one embodiment of the invention.

In at least some embodiments, and as shown in FIGS. 2 and 3, the at least one additional control pod 340 is located on the lower BOP stack 204. This location is opposed to being located on the LMRP 410.

However, in some other alternative embodiments, the additional control pod 340 is located on the LMRP 410. In yet other alternative embodiments, one additional pod 340 is located on the LMRP 410 while another additional pod 340 is located on the lower BOP stack 204. Such additional pods may each have a different configuration and/or functionality as described throughout the present description or they may have the same.

The provision of at least one additional control pod 340 (and associated control system) provides further redundancy in an expedient way. In this way, continued operation is enabled even if one of the other control pods 310, 320 becomes unavailable since redundancy is still available, even in this case. This may avoid the need e.g. for tripping the LMRP to the surface and back again to the wellhead, which increases the operational time and avoid costly unproductive downtime.

Furthermore, the at least one additional pod 340 may monitor what commands or instructions are sent to the control pod(s) 310, 320 and monitor and indicate to a system and/or operator whether a function successfully was performed or not. In this way, redundancy on the feedback received from the first and/or second pods 310, 320 may be provided.

Accordingly, some embodiments of the invention generally relates to an additional control pod and/or the control system (subsea and/or surface) monitoring the input and/or actions of one or more other control pods.

Furthermore, according to some embodiments of the present invention, the at least one additional control pod 340 may initiate one or more safety critical functions and/or safety instrumented functions (SIFs) in response to a control signal received from the SIS surface control system 350—alternatively via a SIS subsea control unit (as shown as 351 in and as will be explained further in connection with FIG. 3).

Input and other functionality will be explained further in connection with FIG. 3 and elsewhere.

In some embodiments, the at least one additional control pod 340 is adapted to carry out only about ten, e.g. ten, to about twelve, e.g. twelve, (where the actual number may vary and be dependent on actual use or implementation) predetermined functions.

In some embodiments, preferably only safety critical functions and/or SIF functions, are supported by the at least one additional control pod 340.

Accordingly, in some embodiments, the at least one additional control pod 340 is adapted to carry out a number of functions being selected from a predetermined group of safety critical functions (and/or SIF functions). Examples of safety critical functions and/or SIF functions are given in the following.

Letting the at least one additional control pod 340 being adapted to only carry out the functions designated as safety critical functions keeps to overall number of supported functions relatively low (reducing complexity and/or potential failure rate of the (at least one) additional control pod 340 compared to either of the first and second control pod 310, 320) while providing additional redundancy and/or back up for the (e.g. most) safety critical functions.

In contrast, current (first/blue, second/yellow) conventional control pods support up to as much as about 160 different functions. Supporting far fewer functions reduces the overall complexity of the additional control pod 340, and possibly its manufacturing costs, compared to the conventional control pods. Having fewer functions may very well reduce the potential failure rate of an additional control pod 340 compared to conventional control pods 310, 320.

Accordingly, in some embodiments the invention generally relates to the incorporation of at least one (3rd) additional pod 340 (additional to first/BL and second/YL) with fewer functions than the first/BL and second/YL control pods (such as fewer than 50% or less, such as fewer than 60% or less, such as fewer than 70% or less, such as fewer than 80% or less, and such as fewer than 90% or less of of the number of function supported by the first/BL and second/YL control pods) where the 3rd additional pod 340 is connected to an additional control panel on the surface as described elsewhere.

In some embodiments, the predetermined group of safety critical functions mentioned above comprises one or more selected from the group of: closing of one or more, e.g. all, shear ram (e.g. (UBSR HP close, CSR HP close, LBSR HP close), closing of one or more, e.g. all, pipe ram, engaging ram locks, autoshear and deadman functions, and/or unlatching a lower marine riser package connector, thereby enabling separating the lower marine riser package 410 from the lower blowout preventer stack 204.

The safety critical functions may also be included as part of an EDS (Emergency Disconnect System) function or sequence. The EDS system or function may trigger in the event that communication to the surface is lost (typically loss of high-pressure hydraulics) but could in principle also (or in the alternative) be triggered in the event of loss of connection via both MUX cables. In such event, the EDS will close (or attempt to close) the well by closing one or more rams and/or annular BOPs typically via pressure from the subsea accumulators such as accumulator bottles, and subsequently disconnect of the LMRP.

In one embodiment, the invention generally relates to a system for cutting hydraulic supply to the BOP so as to activate the EDS function or sequence, e.g. via a push button (or push of two buttons at the same time) on a control panel or the like above surface, This is advantageous in the event that both MUX cables becomes dysfunctional and provides a convenient method of quickly closing the lower BOP stack.

It is also to be understood, that other functions may be used as safety critical functions.

In some embodiments, e.g. as shown in FIG. 3, the BOP system 200 further comprises one additional subsea control unit (see e.g. 351 in FIG. 3), which will be explained further in connection with FIG. 3. In addition or alternatively to the additional control pod initiating one or more safety instrumented functions (SIFs), the additional subsea control unit may initiate one or more safety instrumented functions (SIFs) in response its own control logic.

In some embodiments, the BOP system 200 further comprises at least one acoustic control pod (see e.g. 340, 341 in FIG. 3) and one or more acoustic subsea control units (see e.g. 345 in FIG. 3) as shown and explained further in connection with FIG. 3. The acoustic control pod and acoustic subsea control units provide another way of communicating (acoustic communication) with the lower BOP stack 204, e.g. in the event of loss of connection via both MUX cables.

In some embodiments, the drilling rig further comprises a spare MUX reel enabling fast replacement, The connections between the shown entities are, in this and corresponding exemplary embodiments, hydraulic or electrical as indicated by the connecting lines being either full (hydraulic) or broken (electric). Optical connections may be used, at least somewhere, as an alternative to electric connections.

In some embodiments, the at least one additional control pod 340 is controllable to be enabled, disabled, or electrically live only.

Enabled may be defined as electrical power, communications, and hydraulics live in the at least one additional control pod and associated control circuits.

Disabled may be defined as electrical power, communications, and hydraulics disabled in the at least one additional control pod and associated control circuits. Electrically live may be defined as electrical power and communications being live and hydraulics being disabled.

In some embodiments, the at least one additional control pod 340 is controllable to enter a lower blowout preventer stack 204 test mode, and/or enter a test mode for the at least one additional control pod 340.

FIG. 3 schematically illustrates a BOP control system according to one embodiment of the invention.

Shown in FIG. 3 is a BOP control system corresponding to the one shown in FIG. 2 but with further details given.

Shown is a surface control system 330, at least one additional surface control system 350 (designated SIS Surface Control Unit), one or more hydraulic subsea accumulators or the like 360, at least one additional control pod 340, a lower blowout preventer stack 204 capable of performing a number of BOP functions 370, and an LMRP 410 capable of performing a number of LMRP functions 385 that all correspond to the same units as shown and explained in connection with FIG. 2 and elsewhere.

The LMRP 410 is (releasably) connected with the lower BOP 204 via one or more hydraulic connection elements 381, e.g. one or more hydraulic stabs or the like, and one or more electrical (or alternatively optical) connectors 382, e.g. an electrical (or alternatively optical) wet-mate or the like.

In some embodiments and as further shown, the blowout preventer system 200, and more specifically the lower blowout preventer stack 204, further comprises an autoshear and deadman hydraulic circuit 365 that is responsible for carrying out a number of autoshear and/or deadman functions using hydraulic fluid from the accumulators 360.

The one or more subsea accumulators 360 is/are connected to the additional control pod 340, the autoshear and/or deadman hydraulic circuit 365, and/or, if present, one or more acoustic control pods (see below), In some embodiments and as further shown, the blowout preventer system 200, and more specifically the lower blowout preventer stack 204, further comprises at least one additional subsea control unit 351 wherein the at least one additional subsea control unit 351 is/are adapted to control, during use, one or more of the at least one additional control pods 340, e.g. automatically as explained in the following and/or under the control of the additional surface control system 350.

The additional subsea control unit(s) 351 is/are connected (e.g. by electric and/or optical connection, etc.) to one or more of the at least one additional control pods 340 in order to control them.

The additional subsea control unit(s) 351 is/are further connected (e.g. by electric and/or optical connection, etc.) to the additional surface control system 350 for receiving control information and commands and send back feedback signals.

In some embodiments and as shown, the one or more subsea control unit(s) 351 each comprises a battery or other electrical power source 346 to supply, during use, the given subsea control unit(s) 351 with electrical power to generate one or more electrical control signals. In some embodiments and as shown, the blowout preventer system 200, and more specifically the lower blowout preventer stack 204, further comprises at least one acoustic control pod 340 (see e.g. also 341 in FIG. 1) and one or more acoustic subsea control units 345 adapted, during use, to control the at least one acoustic control pod 340.

In some embodiments, the one or more acoustic subsea control units, each comprises a battery or other electrical power source 346 to supply, during use, the given acoustic subsea control units 345 with electrical power to generate one or more electrical control signals.

In some of the embodiments comprising at least one acoustic control pod, one (or potentially two or more for such embodiments) of the additional control pod(s) 340 are integrated together with the acoustic control pod as shown in the Figure.

In general, the additional pod 340 is in some embodiments arranged to receive wireless (such as acoustic) input and/or ROV manipulation.

In some embodiments the battery pack of the acoustic and the additional pod 340 is shared and in some embodiments the battery is ROV replacable.

In some embodiments, the at least one additional control pod 340 comprises a number (e.g. three as shown) of control valves or other control mechanisms (e.g. dual valves, dual coil solenoid valves as shown, etc.) 403 where each control valve or other control mechanism 403 is adapted, during use, to receive a control signal from the additional subsea control unit 351 and, if present, the one or more acoustic subsea control units 345 in order to carry out an associated function.

In embodiments with dual valves, dual coil solenoid valves, etc. (i.e. one or more control valves, each receiving control signals from at least two sources), the at least one additional control pod 340, at least in some embodiments, need only a control signal from one of the at least two sources to be able to react.

In some embodiments, the one or more additional subsea control units 351 and/or the one or more acoustic subsea control units 345 controls the at least one additional control pod 340 using electric and/or optical signals.

In some embodiments, the additional subsea control unit 351 and/or the additional surface control system 350 are adapted, during use, to monitor one or more functions of the lower BOP stack 204 and/or the LMRP 410.

In some embodiments, the additional subsea control unit 351 and/or the additional surface control system 350 are adapted, during use, to automatically take safety measures (such as initiating safety critical functions or safety instrumented functions) in response to the monitoring and/or according to one or more predetermined conditions.

In particular, input signal(s) provided to the first and/or second control pods (see e.g. 310, 320 in FIGS. 1, 2 and 4) may be monitored in order to determine whether a corresponding action is executed and completed by the first and/or the second control pod and/or the lower BOP 204/LMRP 410. If this is not the case (such as within a predetermined amount of time) then the additional control pod(s) 340 take/takes action to execute the function and/or another safety critical function.

The additional subsea control unit 351 may initiate one or more safety instrumented functions (SIFs), e.g. using the additional control pod 340, in response to a control signal received from the additional surface control system 350.

In addition or alternatively, the additional subsea control unit 351 may initiate one or more safety instrumented functions (SIFs), e.g. using the additional control pod 340, in response its own control logic.

The additional subsea control unit 351 may initiate one or more of these safety critical functions or SIFs using the one or more additional control pods 340.

In some embodiments, and as further shown, the blowout preventer system 200, and more specifically the LMRP 410 comprises a power and/or communication hub 384, e.g. a data bus system for transporting data to and/or from the first and/or second control pods (not shown; see e.g. 310, 320 in FIGS. 1, 2, and 3), and a network switch (e.g. comprising an AC/DC converter if required) or the like 383 where the network switch is located in the communications path between the additional surface control system 350 and the one or more electrical or optical connectors 382.

Input/command and feedback signals relating to the first and/or second control pods, the status of the BOP rams/annular, etc. may thus be forwarded to the additional surface control system 350 and/or the additional subsea control unit 351.

Information about the commands (and potentially status) issued to the first and/or second control pod may in this way be forwarded to the additional control units (surface 350 and/or subsea 351) enabling them to monitor what commands are given and whether they are completed or not and if not then react to notify an operator (e.g. on a surface panel) and/or react by executing the commands using the additional control pod 340.

In order to efficiently control the at least one additional control pod 340, the additional subsea control unit 346 and/or the additional surface control system 350 should receive various input, status, and/or feedback signals, e.g. as described in the following.

In some embodiments, the additional surface control system 350 is adapted to receive one or more input signals, during use, from one or more of:

- the surface control system 330 (see also 331, 332 in FIG. 4),
- a surface flow meter 404, measuring one or more current flows of hydraulic fluid to the lower blowout preventer stack 204, e.g. via a hotline conduit or similar i.e. a line providing high pressure hydraulics from the surface to the LMRP 410/lower BOP stack 204),
- the lower marine riser package LMRP 410 or a pressure transmitter 401 located on the LMRP 410, and/or
- the power and/or communication hub (384), e.g. a data bus system for transporting data to and/or from the first and/or second control pods (see e.g. 310, 320 in FIGS. 1, 2, and 4) or similar of the LMRP 410.

Accordingly, in some embodiments of the invention generally relates to an additional control pod and/or the control system (subsea and/or surface) monitoring the input and/or actions of one or more other control pods.

In some embodiments, the at least one additional subsea control unit 351 is adapted to receive one or more input signals, during use, from one or more selected from the group consisting of:

- the power and/or communication hub or similar 384 of the LMRP 410,
- a position and pressure sensor 402 and/or a pressure transmitter 401 of the lower BOP stack 204,
- a pressure transmitter 401 of the autoshear hydraulic circuit 365, e.g. located on a pilot hydraulic autoshear valve),
- a pressure transmitter 401 of a deadman hydraulic circuit 365, and/or
- one or more pressure transmitters 401 of a closing shear ram circuit and/or a blind shear ram circuit.

In some embodiments, the additional surface control system 350 is adapted to receive, during use, one or more input signals representing one or more input signals 501 to the first and/or second control pods (see e.g. 310, 320 in FIGS. 1, 2, and 4), one or more measured current flows 502 of hydraulic fluid to the lower blowout preventer stack 204, a LMRP disconnect feedback signal 503, e.g. as obtained by a pressure transmitter 401 or similar at LMRP 410, and/or one or more signals 504, e.g. obtained from the power and/or communication hub or similar 384 of the LMRP 410.

In some embodiments, the additional subsea control unit 351 is adapted to receive, during use, one or more input signals representing one or more signals 504 obtained from the power and/or communication hub or similar 384 of the LMRP 410, one or more values 505 of one or more blowout preventer system functions 370, e.g. as obtained by a position and pressure sensor 402 or a pressure transmitter 401 of the lower BOP stack 204, a feedback close signal 506 for an autoshear hydraulic circuit 365, e.g. as obtained by a pressure transmitter 401 of the autoshear hydraulic circuit 365, a feedback close signal 506 for a deadman hydraulic circuit 365, e.g. as obtained by a pressure transmitter 401 of the deadman hydraulic circuit 365, and/or one or more feedback close signals 506 for at least one closing shear ram circuit and/or at least one blind shear ram, e.g. as obtained by one or more pressure transmitters 401 of a closing shear ram circuit and/or a blind shear ram.

Above is provided an array of examples of various feedback signals i.e. signals providing an indication of whether a function has been or is in the process of being performed such as by measuring a position of a ram-piston, the flow of hydraulic fluid, pressure, the disengagement of the LMRP, etc.

The feedback examples of above may be generalized to any suitable sensor signal that may be used to provide such indications.

One or more safety instrumented functions (SIFs) may be initiated, by the additional subsea control unit 351 and/or the additional surface control system 350 in response to receiving one or more of the input signals e.g. as listed above and/or in response to receiving input from one or more of the selected unit, systems, or functions e.g. as also listed above.

In some embodiments the additional surface control system is arranged to indicate a successfully performed function. In this way redundancy on the feedback received to the first and/or second control pods may be provided.

Accordingly, in some embodiments the invention generally relates to one or more additional control pods optionally with a control system arranged to receive one or more input signals provided to the first and/or second control pods, monitor whether a corresponding action is executed and completed by the first and/or second control pod and/or the BOP/LMRP.

If this is not the case (such as within a predetermined time) then the additional pod(s) takes action to execute the function and/or another safety critical function. Input/command and feedback signals relating to the first and/or second control pods, the status of the BOP rams/annular, etc. may be received by the additional surface control system 350 and/or the additional subsea control unit 351.

In some embodiments, the additional subsea control unit 351 and/or the additional surface control system 350 is/are adapted to activate, during use, at least one safety instrumented function (SIF) in response to one or more of the following:

a lower marine riser package disconnect feedback signal 503, where the disconnect feedback signal indicates whether a disconnect signal has been given and/or executed, e.g. as obtained by a pressure transmitter 401 or similar at the LMRP 410, and/or a combination ('OR' or 'AND' in any given combination) of one or more values 505 of one or more blowout preventer system functions 370, e.g. as obtained by a position and pressure sensor 402 and/or a pressure transmitter 401 of the lower blowout preventer stack 204, a feedback close signal 506 for an autoshear hydraulic circuit 365, e.g. as obtained by a pressure transmitter 401 of the autoshear hydraulic circuit 365, e.g. located on a pilot hydraulic autoshear valve), a feedback close signal 506 for a deadman hydraulic circuit 365, e.g. as obtained by a pressure transmitter 401 of the deadman hydraulic circuit 365, and/or one or more feedback close signals 506 for at least one closing shear ram circuit and/or at least one blind shear ram, e.g. as obtained by one or more pressure transmitters 401 of a closing shear ram circuit and/or a blind shear ram.

In this way, redundancy is provided (even if one of the first and second control pods becomes unavailable. Furthermore, a (potentially simpler and therefore more reliable) safety system (additional control pod 351, additional subsea control unit 351, and additional surface control system 350) is provided increasing the safety and in certain embodiments being able to monitor the first and second control pods and the LMRP/BOP functions and react automatically.

According to some embodiments of the present invention, the units, systems, and/or functionality related to the additional subsea control unit 340 and/or the additional surface control system 350, including themselves, is/are certified according to a predetermined safety requirement, rating, standard or the like, e.g. according to a SIL (safety integrity level) rating or standard.

In some embodiments, a SIL rating of 2 is provided for the units, systems, and/or functionality related to the additional subsea control unit 351 and/or the additional surface control system 350—including themselves.

SIL 2 rated functions are called Safety Integrity Functions and ensure safe operations and safe response to any departure from normal operating conditions. The SIL concept is related to the Probability of Failure on Demand, which is the probability of a system failing to respond to a demand for action arising from a potentially hazardous condition, SIL 2 relates to a maximum allowed probability of failure on demand per year of 0.01 (a minimum Risk Reduction Factor of 100).

More specifically, at least one or more, and in some embodiments all, of the following, are SIL rated (e.g. to a SIL rating of 2) as one connected system:

the additional subsea control unit 351, the additional surface control system 350, and the at least one additional control pod 340.

In some embodiment the first and second control pods (see e.g. 310, 320 in FIGS. 1, 2, and 4) as well as the input to these (which may be provided to the connected system for monitoring and/or control purposes) are not encompassed as part of the one connected system.

In some embodiments, one or ore of the components are included.

In some embodiments, also in connection with the above embodiment(s) of SIL (SIL 2 rating), the pressure transmitters, the surface flow meter, (if present) the position and pressure sensor, the electrical connector/electrical wet-mate, the hydraulic connector/stab, and (if present) the network switch+AC/DC converter are also SIL rated (e.g. to a SIL rating of 2) as part of the one connected system.

Figure 4:
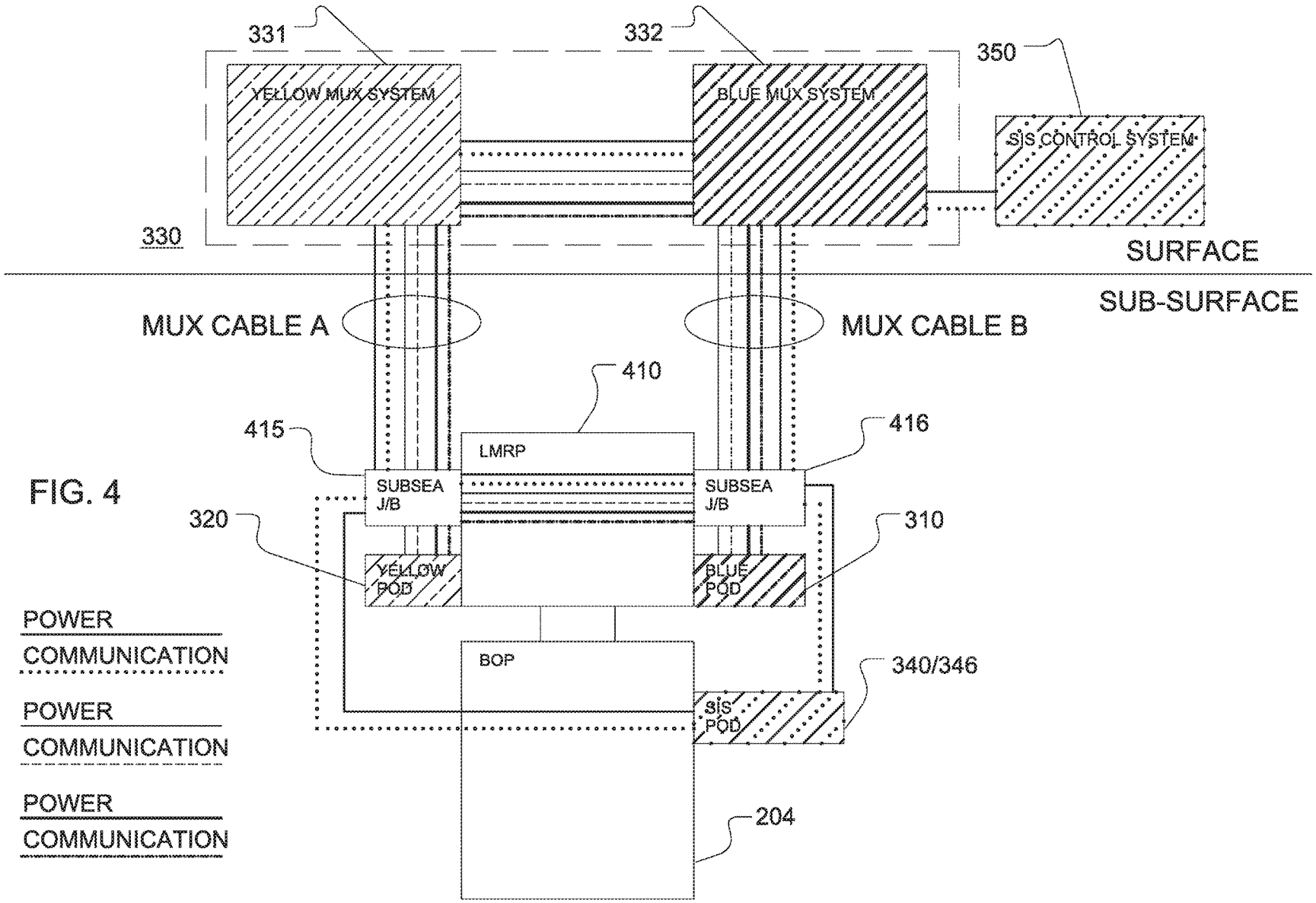
FIG. 4 schematically illustrates one exemplary implementation of subsea junction boxes for power, control and/or communication signals in the BOP control system.

FIG. 4 schematically illustrates one exemplary implementation of subsea junction boxes for power, control and/or communication signals in the BOP control system.

Shown is a system corresponding to the ones shown and explained earlier and one embodiment of how the various elements may communicate together and receive/transfer power using two subsea junction boxes thereby providing redundancy in this respect.

In some embodiments and as shown, the BOP system comprises one or more subsea junction boxes (or similar) 415, 416, such as two, so that power, communication and/or control signals may be cross connected where the similar connections run through both mux cables A, B.

In this way one or more, such as all, of the first, second, and the one or more additional control pods 310, 320, 340 (and one or more acoustic pods 346 if any; e.g. integrated together with the additional control pod(s) 340) may communicate with the surface even if one of the MUX cable are dysfunctional.

Specifically, in some embodiments and as shown, the additional control pod 340 is connected to two junction boxes 415, 416 that may be connected to each other and to each of the first and second control pods 310, 320.

In some embodiments, the subsea junction boxes 415, 416 are located on the LMRP 410.

In some embodiments, not all connections need to be connected through one of the surface control systems 331, 332 but may still run in both mux cables A, B (also referred to as first cable and second cable), e.g. the connections for the yellow pod 320 may run in mux cable B but instead of being connected to the blue mux control system 332 it may connect directly to the yellow mux control system 331 in the overall surface control system 330 and correspondingly for the connections for the blue pod 310. This still provides redundancy and all connections in both mux cables A, B. The surface control systems may be designated as a first (or yellow) surface control system 331 and as a second (or blue) surface control system 332.

The connections between the shown entities are, in this and corresponding exemplary embodiments, power or communication as indicated by the connecting lines being either full (power) or broken (communications). Electrical and/or optical connections may be used, at least somewhere, for communication.

Throughout the description, the used symbols in the drawings may have a different meaning than what they traditionally may represent. In such cases, the meaning is then the meaning as written in the description.

In the claims enumerating several features, some or all of these features may be embodied by one and the same element, component or item. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, elements, steps or components but does not preclude the presence or addition of one or more other features, elements, steps, components or groups thereof.

The invention claimed is:

1. A blowout preventer system comprising:

a lower blowout preventer stack comprising a number of hydraulic components, a lower marine riser package comprising a first control pod and a second control pod adapted to provide, during use, redundant control of the hydraulic components of the lower blowout preventer stack where the first and the second control pods are adapted to being connected, during use, to a surface control system and to be controlled, during use, by the surface control system, wherein the lower blowout preventer stack further comprises an additional control pod connected to an additional surface control system separate from the surface control system and to be controlled, during use, by the additional surface control system to provide control of the same hydraulic components of the lower blowout preventer stack, wherein the blowout preventer system further comprises an additional subsea control unit, wherein the additional subsea control unit is connected to the additional control pod, and adapted to control, during use, the additional control pod and wherein the additional subsea control unit is further connected to the additional surface control system.

2. The blowout preventer system according to claim 1, wherein the first and second control pods are each capable of performing a number of functions and the additional control pod is capable of performing a fewer number of functions compared to the number of functions supported by the first and second control pods.

3. The blowout preventer system according to claim 1, wherein the first and second control pods are each capable of performing a number of functions and the additional control pod is capable of performing a number of fewer functions that is 50% or less of the number of functions supported by the first and second control pods.

4. The blowout preventer system according to claim 1, wherein the blowout preventer system further comprises an acoustic control pod and the additional control pod comprises or is integrated with the acoustic control pod.

5. The blowout preventer system according to claim 1, wherein the additional subsea control unit is adapted, during use, to monitor one or more functions of the lower blowout preventer stack.

6. The blowout preventer system according to claim 1, wherein the additional subsea control unit is adapted to receive one or more input signals, during use, from one or more selected from the group consisting of:

a power hub of the lower marine riser package, a communication hub of the lower marine riser package, a position and pressure sensor of the lower blowout preventer stack, a pressure transmitter of the lower blowout preventer stack, a pressure transmitter of an autoshear hydraulic circuit, a pressure transmitter of a deadman hydraulic circuit, one or more pressure transmitters of a closing shear ram circuit, and one or more pressure transmitters of a blind shear ram circuit.

7. The blowout preventer system according to claim 1, wherein the additional subsea control unit is adapted to receive, during use, one or more input signals representing
- one or more signals of the lower marine riser package,
- one or more values of one or more blowout preventer system functions,
- a feedback close signal for an autoshear hydraulic circuit,
- a feedback close signal for a deadman hydraulic circuit,
- one or more feedback close signals for at least one closing shear ram circuit, and
- one or more feedback close signals for at least one blind shear ram.

8. The blowout preventer system according to claim 1, wherein the additional subsea control unit is adapted to initiate, during use, one or more safety instrumented functions in response to one or more of a control signal received from the additional surface control system and a control logic of the additional subsea control unit.

9. The blowout preventer system according to claim 1, wherein the additional control pod is controllable to enter one or more of a lower blowout preventer stack test mode and a test mode for the additional control pod.

10. The blowout preventer system according to claim 1, wherein one or more of the following, are SIL rated as a connected system:
- the additional surface control system, and
- the additional control pod.

11. The blowout preventer system according to claim 1, wherein one or more of the following, are SIL rated as a connected system:
- the additional subsea control unit,
- the additional surface control system, and
- the additional control pod.

12. The blowout preventer system according to claim 1, the additional surface control system is adapted to activate, during use, at least one safety instrumented function in response to one or more predetermined conditions.

13. The blowout preventer system according to claim 12, wherein the predetermined conditions is selected from the group of
- a lower marine riser package disconnect feedback signal
- a combination of
  - one or more values of one or more blowout preventer system functions as obtained by one or more of a position sensor, and pressure sensor and a pressure transmitter of the lower blowout preventer stack; and
  - a feedback close signal for an autoshear hydraulic circuit;
  - a feedback close signal for a deadman hydraulic circuit;
  - a feedback close signals for at least one closing shear ram circuit; or
  - a feedback close signals for at least one blind shear ram.

14. The blowout preventer system according to claim 1, wherein the additional subsea control unit is adapted to activate, during use, at least one safety instrumented function in response to one or more predetermined conditions.

15. The blowout preventer system according to claim 14, wherein the predetermined conditions are selected from the group of:
- a lower marine riser package disconnect feedback signal
- a combination of:
  - one or more values of one or more blowout preventer system functions as obtained by one or more of a position sensor, and pressure sensor and a pressure transmitter of the lower blowout preventer stack; and
  - a feedback close signal for an autoshear hydraulic circuit;
  - a feedback close signal for a deadman hydraulic circuit;
  - a feedback close signals for at least one closing shear ram circuit; or
  - a feedback close signals for at least one blind shear ram.

16. The blowout preventer system according to claim 1, wherein communication lines between the surface control system and the first and second control pods are independent of a communication line between the additional control pod and the additional surface control system.

17. A blowout preventer system comprising:
- a lower blowout preventer stack comprising a number of hydraulic components,
- a lower marine riser package comprising a first control pod and a second control pod adapted to provide, during use, redundant control of the hydraulic components of the lower blowout preventer stack where the first and the second control pods are adapted to being connected, during use, to a surface control system and to be controlled, during use, by the surface control system,
- wherein the lower blowout preventer stack further comprises an additional control pod connected to an additional surface control system separate from the surface control system and to be controlled, during use, by the additional surface control system to provide control of the same hydraulic components of the lower blowout preventer stack,
- wherein the blowout preventer system comprises
  - a first cable connecting at least the first control pod with a first surface control system, adapted to control the first control pod, and
  - a second cable connecting at least the second control pod with a second surface control system, adapted to control the second control pod,
- wherein the first and second cables are connected to the additional control pod and
- wherein the additional surface control system is connected to one or more of the first cable, the second cable, the first surface control system and the second surface control system.

18. The blowout preventer system according to claim 17, wherein
- the first cable is connected to a first subsea junction box being connected to the first control pod and the additional control pod, and
- the second cable is connected to a second subsea junction box being connected to the second control pod and the additional control pod, wherein the first and second subsea junction boxes are connected and further adapted to cross connect signals of one or more conductors of the first and second cables, respectively, and to cross connect one or more of
- signals of one or more conductors between the first junction subsea box and the additional control pod, and
- signals of one or more conductors between the second subsea junction box and the additional control pod.

19. The blowout preventer system according to claim 17, wherein the first surface control system is further adapted to control the second control pod, the second surface control system is further adapted to control the first control pod, and the additional surface control system is adapted to control the additional control pod selectively via the first or second cables.

20. The blowout preventer system according to claim 17, wherein communication lines between the surface control system and the first and second control pods are independent of a communication line between the additional control pod and the additional surface control system.

* * * * *